United States Patent [19]

Van Meenen

[11] 4,313,298

[45] Feb. 2, 1982

[54] TAPING INSTALLATION

[75] Inventor: Pierre Van Meenen, Rainvillers, France

[73] Assignee: Societe Anonyme Fileca, Sainte Genevieve, France

[21] Appl. No.: 106,910

[22] Filed: Dec. 26, 1979

[51] Int. Cl.[3] ..... B65H 81/00; B65H 81/08

[52] U.S. Cl. ..... 57/3; 57/6; 57/31

[58] Field of Search ..... 57/3, 6, 7, 13, 15, 57/31, 32, 264, 11

[56] References Cited

U.S. PATENT DOCUMENTS

| | | | |
|---|---|---|---|
| 2,544,442 | 3/1951 | Boyce | 57/3 |
| 3,063,228 | 11/1962 | Sarracino | 57/3 |
| 3,137,985 | 6/1964 | Bailey | 57/13 |
| 3,486,317 | 12/1969 | Grawey | 57/3 |
| 3,590,567 | 7/1971 | Bonokowski | 57/3 |
| 3,756,004 | 9/1973 | Gore | 57/3 X |

*Primary Examiner*—Donald Watkins

*Attorney, Agent, or Firm*—Wolf, Greenfield & Sacks

[57] ABSTRACT

A wire taping installation provided with a device supplying the wire, a device for receiving the taped wire, a taping device fed with tape, as well as two pulleys round which the wire to be taped passes, the tape being applied against said wire between the two pulleys round which said wire passes and each pulley being connected to an apparatus for measuring the force, an installation in which there are electrical pick-ups respectively associated with said pulleys (2, 3), said pick-ups supplying T'am, T'av signals proportional to the Tam and Tav tensions of the wire round said pulleys (2, 3) and a substractor receiving said T'am, T'av signals so as to form a difference signal, said difference signal being compared in a substractor S2 with a theoretical value quantity (TrO cos $\alpha$) and said difference signal is applied to an amplifier supplying a control signal SC of a device regulating the tension of the tape.

5 Claims, 3 Drawing Figures

TAPING INSTALLATION

The present invention relates to a taping installation and notably to an installation provided with a device supplying the wire and another device receiving the taped wire, as well as with two pulleys round which said wire passes, the taping being performed between said two pulleys, each pulley being mounted at the end of an axle carrying a device for measuring the force, as well as an element supplying the tape so as to apply said tape against the wire with a tension regulated in function of the force measured round said two pulleys.

To this end, the invention provides an installation of the above type, characterized in that it carries electrical pick-ups emitting T'am, T'av signals proportional to the Tam and Tav respective mechanical tensions of the wire round the Pam and Pav pulleys. A substractor 31 receives said T'am, T'av signals so as to form a T'av-T'am signal. Said signal is compared in a substractor Q2 with a theoretical value quantity Tro cos $\alpha$ and the difference signal is applied to an amplifier supplying an operating signal SC to a device acting on the tension of the tape.

According to a further characteristic feature of the invention, the installation carries a differential amplifier receiving the measured signal corresponding to the difference in signals measured by the pick-ups at one of the terminals, the other terminal receiving the theoretical value signal Tro cos $\alpha$.

According to a further characteristic feature of the invention, the device operating the tension of the tape is an electrical brake acting on the feeding reel of the tape 7.

Finally, according to a further characteristic feature of the invention, the installation comprises a display device designed to display the difference in tensions between the pulleys and/or the difference signal between said quantity and the theoretical value quantity Tro cos $\alpha$.

The present invention will be described with more details by means of the attached drawings in which.

Figure 1:
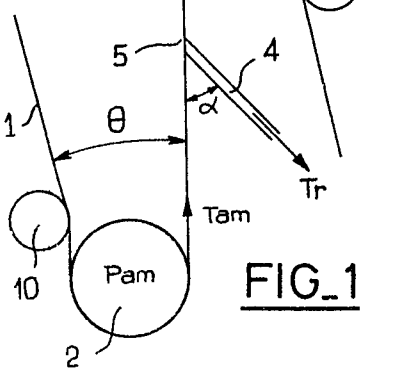
FIG. 1 is a diagram in principle of a taping apparatus.

As shown in FIG. 1, the wire 1 passes on a pulley 2 called "upstream pulley", then on a pulley 3 called "downstream pulley". In the space between said two pulleys 2, 3, a tape 4 is applied in spiral about said wire 1. Thus provided with the tape, the wire leaves the pulley 3 for undergoing physical or chemical treatments or for being simply stocked round a reel.

The tension of the wire 1 before the taping point 5 is the Tam tension. The tension of the wire 1 after said taping point is the Tav tension. The tension of the tape 4 is the Tr tension. If the tape Tr is making an angle $\alpha$ with the line of the wire 1 between the two pulleys 2, 3, the Tam, Tav and Tr tensions are linked to one another by the following algebraic relation:

$$Tav - Tam = Tr \cos \alpha$$

The angle $\alpha$ is selected in function of the nature of the tape and of the product to be produced.

Said angle $\alpha$ is constant all over a taping operation. The taping installation measures the Tam and Tav tensions respectively on a level with each pulley 2, 3 so that the above relation gives the value of the Tr tension. Said Tr tension is thus brought under control through the difference Tav-Tam of the theoretical value tension Tro.

Figure 2:
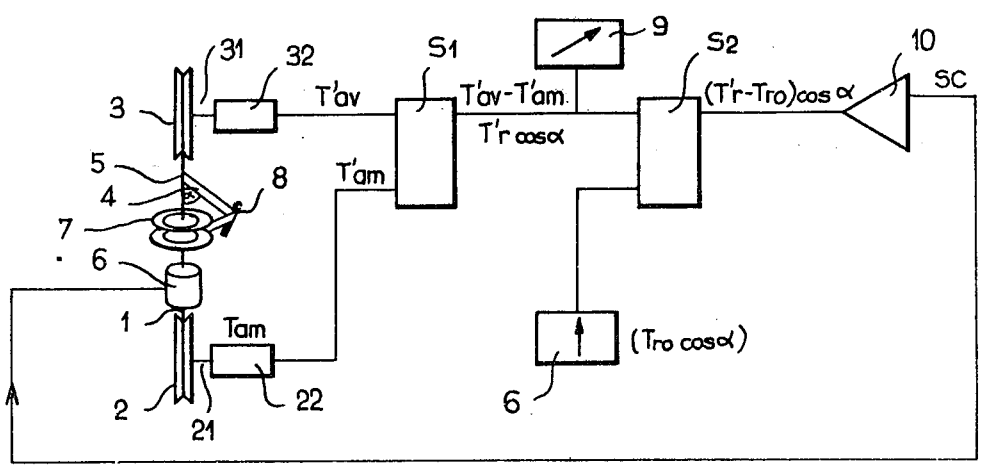
FIG. 2 is a diagram of the whole of the taping installation provided by the invention.

As shown in FIG. 2, and so as to work the general principles described hereabove, the taping installation disclosed by the invention consists of an upstream pulley 2 and a downstream pulley 3. Each of said pulleys is respectively integral with an axle 21, 31 fitted into a bearing 22, 23. The wire 1 firstly passes round the pulley 2, then through a brake 6, then through the reel 7 containing the tape which is applied about the wire 1 at the taping point 5. Said tape 4 which makes an angle $\alpha$ with the axle of the wire 1 passes at least on a deflector 8 which makes the tape turn about said wire 1.

The bearings 22 and 32 each carry a strain pick-up not shown, each supplying a T'av, T'am signal proportional to the mechanical Tam and Tav tensions of the wire 1 on each respective pulley 2, 3. Said two T'am and T'av signals are applied to a substractor S1 which supplies a difference signal $T' - T' \cos \alpha = T'av - T'am$. Said signal ($T'r \cos \alpha$) is proportional to the Tr tension of the tape 4.

Said difference signal can be displayed on a display device 9. The signal ($T'r \cos \alpha$) and a theoretical value signal ($TrO \cos \alpha$) supplied by a theoretical value generator G both are applied to a substractor S2 which supplies the difference between said both signals. The difference signal $(T'r - TrO) \cos \alpha$ is applied to an amplifier 10 which generates a control signal SC applied to the brake 6. Said brake 6 may be an electrical brake or a mechanical brake.

Said amplifier 10 has a power gain and a characteristic of phase-frequency response such that it can control at the same time tensions ranging from some half a score grammes to some Kgs., with accuracy and faithfulness, while securing a stable working to the regulating system.

According to an advantageous mode of embodiment, the pick-ups of the bearings 22, 23 which detect the Tam and Tav tensions are pick-ups with extensometers positioned about the axles 21 and 31 of the pulleys 2 and 3. Said pick-ups are positioned in such a way as compensating the thermic variations and the induced efforts by the vibrations of the rotating systems. In fact, said pick-ups measure the torque exerted by the wire on each of the pulleys.

Each pulley is subjected to a 2 Tam or 2 Tav force. If the lengths of the axles are 1, the pick-ups measure 21 Tam or 21 Tav.

As the lever arm 1 of said torques is constant and does not vary while the installation is working or even when the wire is changed, said pick-ups supply a signal proportional to the respective tension. The working parameters of the pick-ups can be selected so as the proportionality be equal to the unit.

Figure 3:
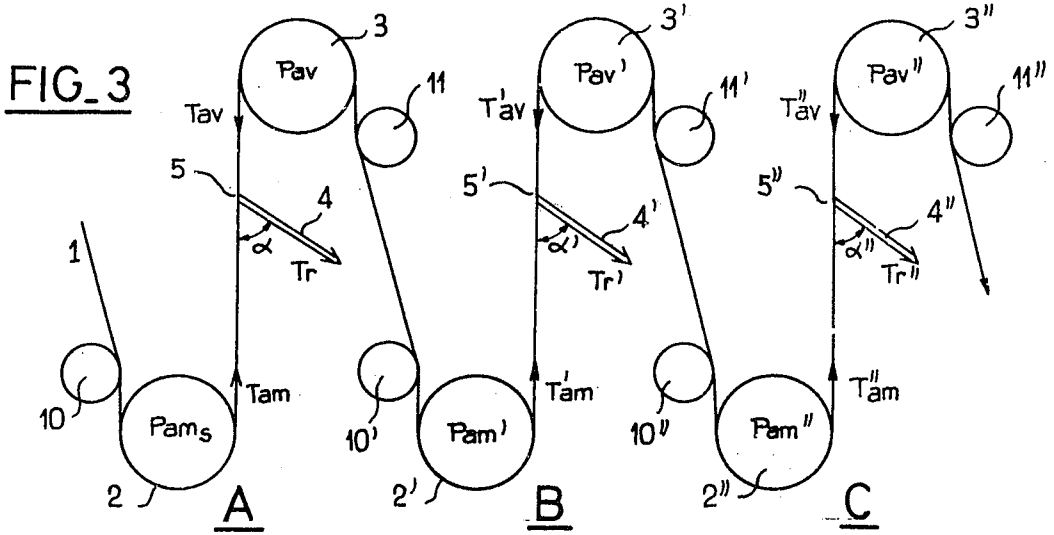
FIG. 3 is a diagram of a taping installation with three taping stations.

In the installation shown in FIG. 3, the wire 1 passes through three taping stations A, B, C in succession so as to receive the tapes 4, 4', 4'' deposited according to an angle $\alpha$, $\alpha'$, $\alpha''$ under a mechanical tension Tr, Tr', Tr''.

Each station is achieved such as diagrammatically shown in FIGS. 1 and 2.

So as to simplify FIG. 3, only the elements and means equivalent to those of FIG. 1 have been shown; in the station A, the elements bear the same reference as those in FIG. 1; in the station B, the elements bear the same references as those in FIG. 1 followed by a first* and in the station C, the references are followed by a second*.

The small deflecting pulleys 10, 11, 10', 11', 10'', 11'' shown in FIGS. 1 and 3 have no determining functional part. Where they are not provided, if G is the angle formed between the entring strand and the outgoing strand round one of the pulleys 2 or 3, 2Tam cos (G/2) or 2Tav cos (G/2) are measured, G being a constant of the machine, it will suffice to take it into account for evaluating Tr with accuracy.

In installation comprising multiple stations, such as shown in FIG. 3, the deflecting pulleys are neither indispensable, and it could be conceived to mount a taping head between the pulley 3 and the pulley 2', for example, after having studied the clearance, the pulley 3 becoming the upstream pulley for the second head and the pulley 2' becoming the downstream pulley without so far going beyond the invention, provided that at each couple of Tam, Tav pick-ups an independant regulating device be associated which would only act upon the tension of the tape deposited by the head acting between the two respective systems.

What I claim is:

1. A wire taping installation comprising a device supplying the wire, a device for receiving the taped wire, a taping device fed with tape, two pulleys round which the wire to be taped passes, the tape being applied against said wire between the two pulleys round which said wire passes, electrical pickup-ups respectively associated with each said pulley, said pick-ups supplying T'am, T'av signals proportional to the Tam and Tav tensions imparted by the wire as sensed at said pulleys, a first subtractor receiving said T'am, T'av signals so as to form a difference signal, a second subtractor, said difference signal being compared in said second subtractor with a theoretical value quantity, amplifier means, said difference signal being applied to said amplifier supplying a control signal to a device for regulating the tension of the tape.

2. An installation according to claim 1, in which said second subtractor comprises a differential amplifier receiving the measured signal corresponding to the difference in the signals measured by the pick-ups at one of the terminals, the other terminal receiving the theoretical value signal Tro cos.

3. An installation according to claim 1, in which the control device is an electrical brake acting upon said tape.

4. An installation according to claim 1, in which there is a display device designed to display the difference in the tensions of the pulley and/or the difference signal between this quantity and the theoretical value quantity Tro cos $\alpha$.

5. An installation according to claim 4, in which there are several devices regulating the tension of the tape for several taping stations arranged in succession along the wire and simultaneously working, each of the assembly of measurement and checking of the tension of the tape being independant from one another.

* * * * *